United States Patent [19]

Roberts

[11] Patent Number: 4,475,658

[45] Date of Patent: Oct. 9, 1984

[54] SPRING-LOADED MERCHANDISING DEVICE

[75] Inventor: Kenneth S. Roberts, Gig Harbor, Wash.

[73] Assignee: Roberts Display Corporation, Gig Harbor, Wash.

[21] Appl. No.: 20,524

[22] Filed: Mar. 14, 1979

[51] Int. Cl.[3] ..... A47F 7/00

[52] U.S. Cl. ..... 211/54.1; 248/220.4; 312/71; 211/59.1

[58] Field of Search ..... 211/49 D, 51, 52, 53, 211/54.1, 57.1, 59.1; 312/61, 71; 248/220.3, 220.4, 221.1, 221.2; 221/279, 280, 312 A

[56] References Cited

U.S. PATENT DOCUMENTS

| | | | |
|---|---|---|---|
| 277,322 | 5/1883 | Mills | 5/256 X |
| 485,995 | 11/1892 | Sundstrom | 312/71 X |
| 802,606 | 10/1905 | Stapp | 211/49 D X |
| 1,202,086 | 10/1916 | Moe | 312/61 |
| 1,923,435 | 8/1933 | Gilpin | 5/256 X |
| 3,251,464 | 5/1966 | Hanson | 211/57.1 X |
| 3,696,937 | 10/1972 | Braverman | 248/220.4 |
| 3,789,440 | 2/1974 | Garceau | 5/256 |
| 3,958,697 | 5/1976 | Brown et al. | 211/54.1 |
| 4,062,137 | 12/1977 | Herzog | 211/59.1 X |
| 4,066,169 | 1/1978 | Hochman | 211/57.1 |

FOREIGN PATENT DOCUMENTS

| | | | |
|---|---|---|---|
| 605468 | 6/1960 | Italy | 221/312 A |
| 429070 | 7/1967 | Switzerland | 312/61 |

*Primary Examiner*—Thomas J. Holko

*Attorney, Agent, or Firm*—Christensen O'Connor Johnson & Kindness

[57] ABSTRACT

A spring-loaded retail merchandising device includes a merchandise display hook and a compression spring coaxially mounted thereon to maintain merchandise hanging from the hook at a forward position on the hook. The hook protrudes from a pegboard or other display surface and supports a number of packages of merchandise items. Each time an item is taken from the hook, the remaining items are pushed forward to thereby maintain a safe, attractive and commercially effective merchandise display.

5 Claims, 4 Drawing Figures

Fig. 1
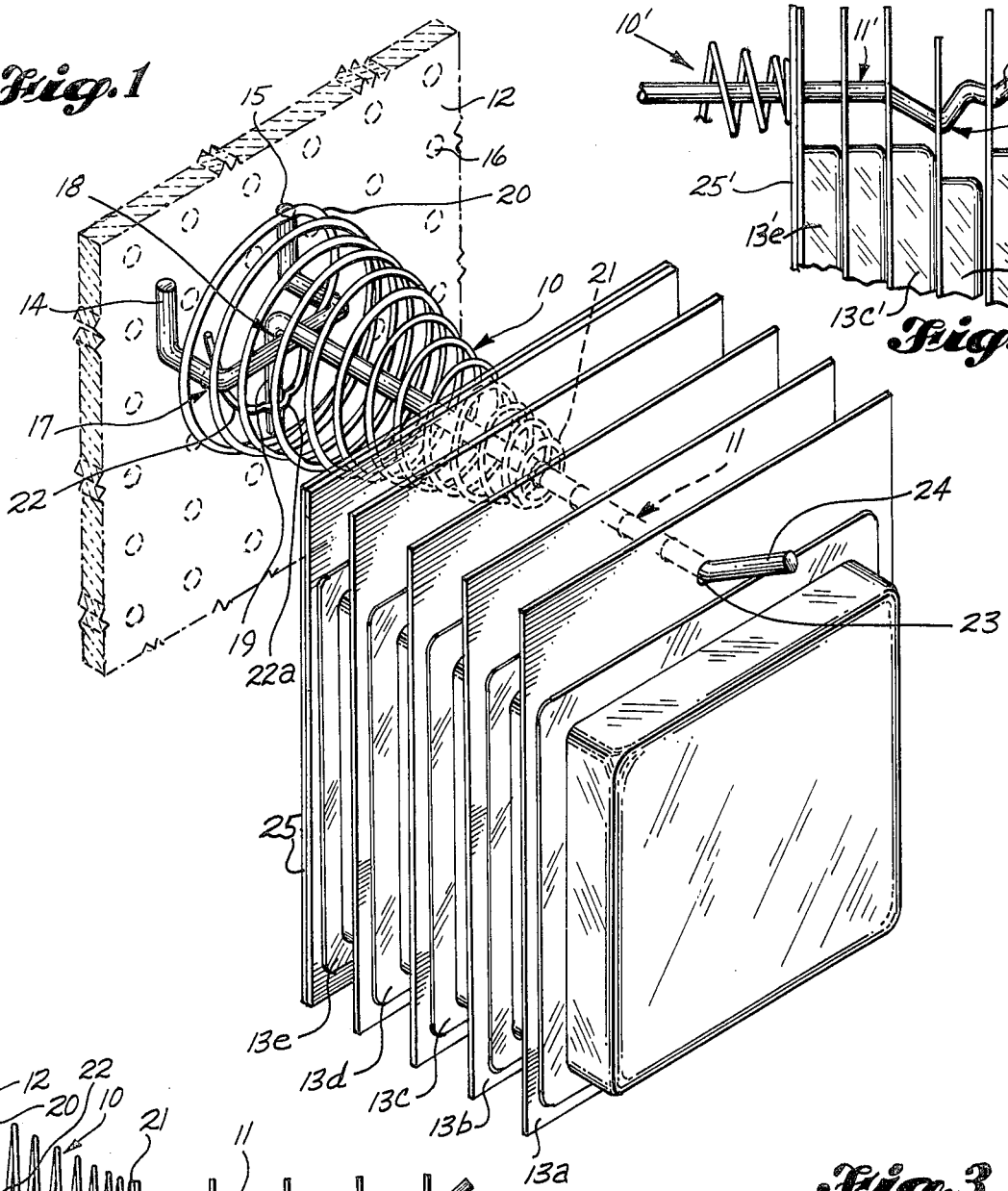
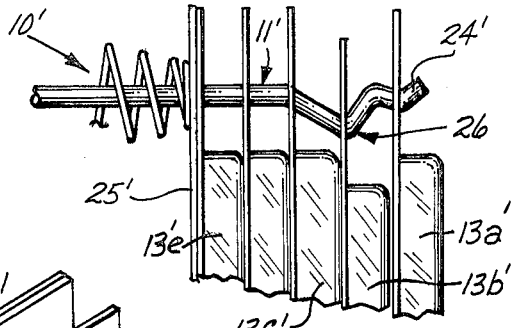
Fig. 4
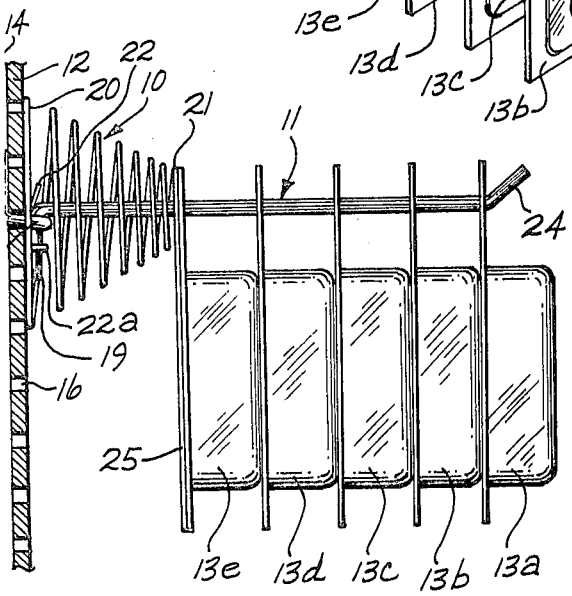
Fig. 2
Fig. 3
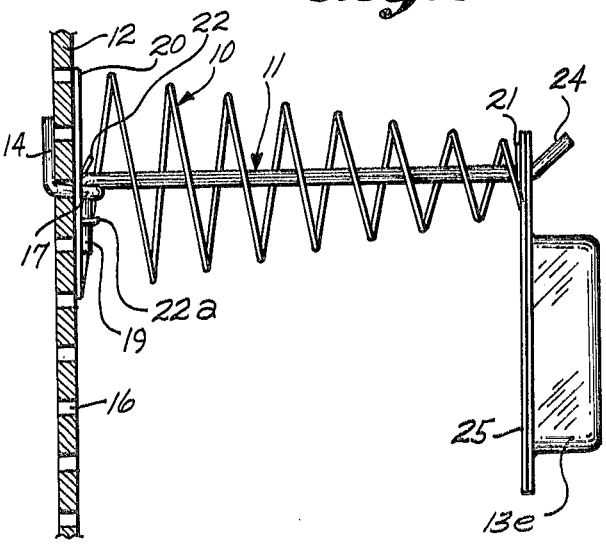

SPRING-LOADED MERCHANDISING DEVICE

BACKGROUND OF THE INVENTION

In the field of retail merchandising, increasing use has been made in recent years of hook and pegboard assemblies for retail display of relatively small merchandise items. Such assemblies typically consist of an upright pegboard to which are attached a number of merchandise hooks or pegs. Retail merchandise items are hung from the hooks, typically by way of a merchandise package having a hole punched at its top. The front package on each hook may be easily removed by a customer for examination or purchase, whereupon the next merchandise item on the hook is visibly displayed.

Point-of-purchase merchandise fixtures are fixtures designed to hold and display retail merchandise on a self-serve basis in retail stores or other enclosed shopping areas. They are designed to encourage and facilitate selection of items by customers without assistance from sales personnel. The items displayed on these fixtures are customarily purchased when the customer is finished shopping and leaves the store through a cash register terminal.

The hook and pegboard assembly is one of several types of point-of-purchase merchandising fixtures commonly available. Other such fixtures include racks, bins and shelves for holding and displaying merchandise items. The retail sales industry has increasingly relied on the hook and pegboard assembly in preference over the other types of fixtures for several reasons.

First, the hook and pegboard assembly presents a neatly arrayed assortment of items. Like items may be grouped together on individual hooks, such that only a single item of each type is displayed at a time. The hooks maintain the merchandise items in an orderly display, yet a customer may nevertheless easily remove an item for examination or purchase and just as easily replace the item without disturbing the display. This is in sharp contrast to bins or shelves. A shelf or bin may be neatly stocked initially, but handling of the goods by customers invariably results in rapid rearrangement of the ordered goods to produce a disordered and unattractive display.

The hook and pegboard display assembly is particularly welladapted to the currently widespread practice of deterring shoplifting by enclosing small retail items in bulky packages. This practice typically takes the form of packaging a small item on a relatively large sheet of cardboard and covering it with a vacuum-formed clear plastic shell, thereby rendering the item bulky and difficult to conceal by a potential shoplifter. Such packages are difficult to display in a pleasing manner in a bin or on a shelf, but can be conveniently displayed on a hook by punching a hole near the upper edge of the cardboard backing and hanging the package from the hook. The hook and pegboard display also further enhances a secondary use of the cardboard backing as an advertising medium whereby printed advertisements may be placed on the front of the cardboard backing around the packaged item. Hanging the items from hooks enables all of the items to be displayed in an upright orientation and facing in the same direction, thus keeping the advertising messages on the cardboard backings properly positioned for easy reading by customers.

The hook and pegboard assembly is also particularly well adapted to displaying goods enclosed in bags, since the bag may be hung by a punched hole in its upper sealed margin. As with the packages described above, the bag itself may be used as an advertising medium as well as a merchandise container, and may be readily displayed in a readable manner on the hook and pegboard assembly.

The hook and pegboard assembly is also preferred because it permits a larger product line to be displayed in a limited retail space than do other types of fixtures. Individual hooks may be arranged as close together on the pegboard as the sizes of the displayed packages will allow, thereby permitting a relatively high density of different product items to be individually displayed. The particular arrangement of the hooks on the pegboard may also be tailored to best display in an attractive manner items of assorted sizes and shapes. This flexibility permits more efficient use of space than can be attained with racks, shelves or bins. Also, the number of each type of item displayed may be kept small by using inventory cards placed on the hook behind the last package of the hook to facilitate rapid restocking of the items when they are exhausted. This further improves on the efficient use of the available space. No other display device offers such an efficient use of valuable retail space.

Despite the above-mentioned advantages of the conventional hook and pegboard display assembly, certain problems have become apparent, the alleviation of which is the object of the present invention. First, the use of literally millions of display hooks protruding towards the passageways and aisles of retail stores has resulted in a disconcertingly large number of personal accidents and injuries. The exposed hooks tend to snag clothing. Much more seriously, the tend to injure persons who fall or who are pushed onto a display, as well as persons who may merely stoop towards a display and fail to see a protruding hook. Children have been the primary victims of these accidents. A rather alarming number of eye injuries and other serious facial puncture injuries have provoked widespread concern within the retailing industry for the safety of these displays. It has been recognized within the industry that a primary reason for the surprising number of eye injuries is the ease with which the hooks may be inadvertently overlooked when they are partially empty. Since they are made of steel wire rods and protrude directly towards the aisles and other customer areas of a store, they are difficult to see from an end-on view after a few or all of the merchandise items have been removed. The hooks are thus prone to causing accidents as customers stoop towards a display or as children play in the aisles. It is also recognized that the difficulty in seeing the wire rod end-on is further aggravated by the background of a myriad of small round holes in the typical pegboard backing.

The concern for safety has prompted the introduction of a number of safety improvements which have proved helpful but not altogether dispositive of the problem. For example, some hooks have been provided with rounded ball ends to make their tips less dangerous. Protective wire guards have also been provided on some displays to enclose the hooks and their merchandise. The protective guards, although quite efficient from a safety standpoint, interfere with casual handling and removal of merchandise items by customers and are also difficult to install where a large number of hooks are densely positioned on a pegboard. The rounded ball ends have likewise not proved entirely satisfactory by themselves because they must be necessarily kept rather small to allow removal of the merchandise, yet small ball ends have proved almost as dangerous as the original wire hook ends. Although these devices and other similar safety features have represented improvements in the safety of hook and pegboard displays, it has been seen desirable to continue to seek ways to even further improve on the safety of these displays.

A commercial problem with hook and pegboard displays is the decrease in sales due to decreasing visibility of remaining merchandise items after the front packages have been removed from a hook. Especially in a large array of merchandise items hung from hooks, the removal of several packages from the front end of a hook leaves the remaining packages at the back end of the hook partially hidden from view. It is well recognized in the retailing industry that this has a direct negative effect on sales of the remaining items. This also gives an unkempt appearance to the overall display, and sales of all items in the display are thereby also negatively affected somewhat. Decreased visibility is particularly a problem with respect to hooks positioned either higher or lower than average eye level. In these cases, the remaining packages at the back of the hook become almost fully obscured, and the problem becomes similar to the well-known problem in the retail industry of selling goods rom a floorlevel shelf.

Accordingly, it is an object of the present invention to provide a hook and pegboard merchandise display device which maintains suspended merchandise items in a neat, orderly array wherein removal of some of the merchandise items does not diminish the visibility of remaining merchandise items on a hook.

It is also a purpose of the present invention to provide a hook and pegboard merchandise display device which offers improved safety characteristics.

SUMMARY OF THE INVENTION

In accordance with the present invention, a merchandise display device includes a display hook and a spring installed thereon behind the displayed merchandise items. The spring keeps the merchandise items pushed to the front of the hook and thereby keeps the forwardmost merchandise item fully displayed at the front end of the hook at all times until the last item is removed from the hook. A retainer at the end of the hook prevents the spring from pushing the items off the end of the hook and yet does not interfere with removal of an item or replacing of an item back onto a hook. The spring may be employed in combination with any of various types of display hooks from which merchandise items are suspended, including plain wire hooks, sheet metal hooks, looped wire hooks, and the like. A variety of types of springs may be employed, including leaf springs, conventional coil springs, and, in the preferred embodiment, a conical compression spring. The spring may be constructed of various materials, including metal, plastic and rubber. The size and shape of the spring may be adapted to the size and weight of the particular merchandise items to be displayed, as well as to the characteristics of the hook such as length, angle and configuration. The spring may be attached to the back of the hook or to the pegboard wall to retain the spring on the hook after all items have been removed. The spring may also be employed in combination with an inventory control card placed between the last merchandise item on the hook and the spring, whereby upon removal of the last item, the inventory control card is pushed to the front of the hook and prominently displayed.

The spring greatly improves on the safety of the display because there is maintained at all times either a merchandise item or the inventory control card prominently visible at the end of the hook. There is thus less tendency for a customer or child to fail to see the hook and inadvertently step into it.

The spring also maintains all merchandise items in a neat and orderly fashion. There are no "dead spaces" where items are hidden from view. Of particular importance to food retailers is the fact that all food items are displayed uniformly at the front of the hooks so that there is no implication of staleness or lengthy shelf life such as there is in the case of the food items remaining on display at the back of a conventional hook.

BRIEF DESCRIPTION OF THE DRAWINGS

FIG. 1 is an isometric view of the preferred embodiment of the present invention.

FIG. 2 is a side view of the preferred embodiment as it might be initially stocked with retail merchandise items.

FIG. 3 is a side view of the preferred embodiment after all but one of the merchandise items have been removed.

FIG. 4 is a side view of an alternative embodiment of the present invention.

DETAILED DESCRIPTION OF THE PREFERRED EMBODIMENT

Referring to FIGS. 1 through 3, in the preferred embodiment of the present invention a merchandise display spring 10 is coaxially positioned about a steel wire display hook 11. The display hook 11 protrudes generally from a pegboard display panel 12. Packages of merchandise items 13*a* through 13*e* are suspended from the display hook 11 and are pushed forward to the front end of the display hook 11 by means of the spring 10.

The display hook 11 is demountably attached to the pegboard 12 by means of upturned mounting hooks 14 and 15 which protrude through holes 16 in the pegboard panel 12. The upturned mounting hooks 14 and 15 are formed at the ends of a wire rod 17 which is bent into the illustrated configuration and spot welded to the display hook 11 at its midpoint. The back end of the display hook 11 is bent downwardly around the midpoint of the wire rod 17 at the position of the spot weld 18 to form a downturned back end portion 19. The display hook 11 is normally installed on the pegboard panel 12 by first holding the hook 11 in an upright position and inserting the ends of the mounting hooks 14 and 15 through two holes 16 on the pegboard panel 12, and then swinging the display hook 11 downwardly to a substantially horizontal position wherein the mounting hooks 14 and 15 and the downturned back end portion 19 support the display hook 11 in a substantially horizontal position on the pegboard panel 12.

In the preferred embodiment, the spring 10 is a conical compression spring having a large diameter end 20 and a small diameter end 21. The conical compression spring 10 is preferred over other types of springs because it can be compressed into a very compact fully compressed state wherein its total axial length is no greater than the thickness of the wire of which the spring 10 is made. The displacement of the spring 10 normally ranges from a slightly compressed, extended position, illustrated in FIG. 3, to various compressed positions, an example of which is illustrated in FIG. 2. The small end of the spring 10 is free to travel along the display hook 11. The large diameter end 20 of the spring 10 is retained at the back end of the display hook 11 by means of a retaining hook 22 formed at the large diameter end 20 of the spring 10. The retaining hook 22 is looped downwardly behind the wire rod 17 and around the front of the downturned back end portion 19 of the hook 11. The retaining hook 22 includes a small, forwardly disposed semicircle portion 22*a* which fits snugly around the front of the downturned back end portion 19 to prevent the retaining hook 22 from being twisted loose. The spring 10 will normally be installed on the display hook 11 before the hook 11 is secured to the pegboard panel 12. However, in instances where a preexisting hook 11 cannot be readily removed from its pegboard panel 12 for installation of the spring 10, the spring 10 may nevertheless be installed without first removing the hook 11 by tilting the hook 11 slightly upwards and twisting the spring 10 onto the hook 11 until the retaining hook 22 locks into position. Once the hook 11 with its associated spring 10 has been installed on the panel 12, the retaining spring hook 22 is locked between the panel 12 and the back of the steel rod 17 of the display hook 11, thus further preventing the spring 10 from being removed without first detaching the display hook 11 from the panel 12.

In an alternative embodiment wherein the hook 11 and spring 10 are manufactured and sold as a complete unit, the large diameter end 20 of the spring 10 is permanently welded to the back of the hook 11 during assembly. The preferred embodiment described herein is, however, particularly adapted to retrofitting of preexisting display hooks 11 with the merchandise display spring 10.

In practice, the packaged merchandise items 13*a* through 13*e* are stocked on the hook 11 by simply hanging them on the hook 11 by means of holes 23 in their upper margins and pushing them rearwardly along the hook 11 to compress the spring 10. The display hook 11 includes an upturned retainer 24 at the front end of the hook 11 to keep the merchandise from sliding off the front end of the hook 11. An inventory control card 25 will customarily be employed between the small end 21 of the spring 10 and the rearwardmost merchandise item 13*e*. After the display hook 11 is fully stocked, merchandise items 13*a* through 13*e* may be removed for purchase one at a time by customers. As each merchandise item is removed, the remaining merchandise items are pushed forward on the hook 11 by the spring 10 to a position wherein the forwardmost merchandise item is at the front end of the hook 11 abutting the retainer 24. For example, FIG. 3 illustrates the merchandise display after all but the last merchandise item 13*e* have been removed. Even after all but the last item 13*e* have been removed, it will be seen that the last merchandise item 13*e* is pushed to the front of the hook 11 so as to display the item 13*e* in a manner visually identical to the display of the first item 13*a* of the fully stocked hook 11. Upon removal of the last merchandise item 13*e*, the inventory control card 25 is prominently displayed at the end of the hook 11. The presence of the inventory control card 25 serves to alert employees to restock the hook 11. The inventory control card 25 may also contain an advertising message.

Another embodiment of the present invention is illustrated in FIG. 4, wherein major features analogous to those of FIGS. 1 through 3 are designated with primed numerals. This embodiment is particularly suited to displaying relatively heavy merchandise items, for example tools, on a hook and pegboard display. A heavy duty spring 10' is employed accordingly. The display hook 11' is provided with a detent 26 positioned to retain the second item 13*b'* on the hook 11. The forwardmost item 13*a'* may thus be removed for examination and thereafter easily replaced on the end of the hook 11' without having to push all the items 13*b'* through 13*e'* back against the force of the heavy duty spring 10'. This facilitates removal of an item for examination and subsequent replacement of the item back onto the hook 11', and thereby reduces the tendency for a customer to remove an item and thereafter lay it elsewhere when it proves momentarily awkward to put the item back on the hook. If the forwardmost item 13*a'* is removed and purchased, the second item 13*b'* remains suspended at the detent 26 where its visibility is, for practical purposes, about the same as it would be at the end of the hook 11. If the second item 13*b'* is then removed from the detente 26 for examination, the third item 13*c'* would slide into the detent 26 and the second item could be replaced on the end of the hook 11 in the same manner as item 13*a'* in FIG. 4.

The merchandise display spring 10 provides a safer merchandise display than has heretofore been achieved because remaining merchandise items, for example the last merchandise item 13*e* in FIG. 3, are maintained at a forwardmost position on the display hook 11. Even when the last merchandise item 13*e* has been removed from the hook 11, the inventory control card 25 is prominently maintained at the end of the hook 11. Because either a merchandise item or the inventory control card 25 is always displayed at the end of the hook 11, there is a decreased probability of a person moving against the hook 11 because of having failed to see the display hook 11 from an end-on viewpoint.

Although the present invention is described and illustrated herein by reference to a particular preferred embodiment and certain alternative embodiments, it will be understood that various alterations, modifications and substitutions may be made by one skilled in the art without departing from the scope of the invention. For example, various types of display hooks may be substituted for the conventional retail display hook 11 described above. Also, various types of spring assemblies may be substituted for the particular conical compression display spring 10 of the preferred embodiment. Therefore, the scope of the present invention is intended to be limited only by the following claims.

The embodiments of the invention in which an exclusive property or privilege is claimed are defined as follows:

1. A merchandise display assembly for displaying merchandise items comprising:

merchandise display support means;

at least one merchandise display hook projecting from said support means for slidably suspending merchandise items therefrom, said display hook having a front end and a back end, said front end of said display hook including a retainer means for retaining merchandise items from sliding off said front end of said display hook, said display hook being attached to said support means at said back end, said display hook including a downturned back portion secured to a transverse wire rod, said transverse wire rod having upturned mounting hooks at each end thereof for securing said display hook to said support means; and a conical compression coil spring operatively associated with said display hook for maintaining said merchandise items pushed forward toward said front end of said display hook, said spring including a large diameter end and a small diameter end, said large diameter end of said spring including a retaining hook demountably attachable to said back end of said display hook, said retaining hook of said spring operably extending downwardly behind said transverse wire rod and around the front of said down-turned back portion of said display hook and further including a forwardly disposed semicircle portion cooperably engageable around the front of said down-turned back portion of said display hook for preventing said retaining hook of said spring from being twisted loose.

2. The assembly of claim 1 further comprising an inventory control card slidably suspended from said display hook between said small diameter end of said spring and a rearwardmost merchandise item.

3. The assembly of claim 1 wherein said display hook further includes a detent spaced back from said front end of said display hook, said detent operating to limit forward sliding of merchandise items toward said front end of said display hook and thereby enable replacement of an item onsaid front end of said display hook without compressing said spring.

4. A merchandise display assembly for displaying merchandise items comprising:

merchandise display support means;

at least one merchandise display hook projecting from said support means for slidably suspending merchandise items therefrom, said display hook having a front end and a back end, said front end of said display hook including a retainer means for retaining merchandise items from sliding off said front end of said display hook, said display hook being attached to said support means at said back end of said display hook, said display hook including a down-turned back portion secured to a transverse wire rod, said transverse wire rod having up-turned mounting hooks at each end thereof for securing said display hook to said support means; and a coil spring operatively associated with said display hook for maintaining said merchandise items suspended from said display hook pushed forward on said display hook, said spring including retaining hook means demountably attachable to said back end of said display hook, said retaining hook means operably extending behind said transverse wire rod and around the front of said down-turned back portion of said display hook to thereby detachably connect said retaining hook means of said spring to said back end of said display hook.

5. The assembly of claim 4 wherein said display hook further includes a detent spaced from said front end of said display hook, said detent operating to limit forward sliding of merchandise items toward said front end of said display hook and to thereby enable replacement of a merchandise item on said front end of said display hook without compressing said spring means.

* * * * *